US008083269B2

(12) United States Patent
Mitchell

(10) Patent No.: US 8,083,269 B2
(45) Date of Patent: Dec. 27, 2011

(54) APPARATUS FOR EFFECTING AN INITIAL, PREDETERMINED TRANSLATION OF A CLOSED SLIDING DOOR

(75) Inventor: Ross Mitchell, Surrey (CA)

(73) Assignee: Vanguard Plastics Ltd., Surrey, BC ( * ) Notice: Subject to any disclaimer, the term of this patent is extended or adjusted under 35 U.S.C. 154(b) by 875 days.

(21) Appl. No.: 12/150,915

(22) Filed: May 2, 2008

(65) Prior Publication Data

US 2008/0211240 A1 Sep. 4, 2008

(51) Int. Cl.
*E05C 9/10* (2006.01)
*E05B 3/00* (2006.01)

(52) U.S. Cl. ..... 292/52; 292/143; 292/173; 292/336.3; 292/DIG. 46; 49/276; 70/95

(58) Field of Classification Search ..... 292/52, 292/143, 165, 173, 177, 179, 336.3, DIG. 46, 292/DIG. 71; 49/276, 278; 70/95–100; 109/73
See application file for complete search history.

(56) References Cited

U.S. PATENT DOCUMENTS

| | | | | | |
|---|---|---|---|---|---|
| 271,001 | A | * | 1/1883 | Thompson | 292/180 |
| 451,702 | A | * | 5/1891 | Sims | 292/241 |
| 466,419 | A | * | 1/1892 | Kelley | 292/123 |
| 700,343 | A | * | 5/1902 | Lincoln | 292/254 |
| 729,980 | A | * | 6/1903 | Vordemfelde | 292/29 |
| 1,064,800 | A | * | 6/1913 | Whitcomb | 292/173 |
| 1,141,513 | A | * | 6/1915 | Allen | 49/221 |
| 2,631,032 | A | * | 3/1953 | Denker et al. | 49/278 |
| 2,659,115 | A | * | 11/1953 | Anderson et al. | 49/277 |
| 3,080,621 | A | * | 3/1963 | Mendelsohn | 49/454 |
| 3,877,739 | A | * | 4/1975 | Cowen | 292/101 |
| 3,912,311 | A | * | 10/1975 | Carvell et al. | 292/216 |
| 4,767,139 | A | * | 8/1988 | Hansing | 292/162 |
| 5,092,144 | A | * | 3/1992 | Fleming et al. | 70/95 |
| 5,522,626 | A | | 6/1996 | Dominique | |
| 5,908,228 | A | * | 6/1999 | Lee | 312/405 |
| 5,915,805 | A | * | 6/1999 | Lee | 312/405 |
| 6,048,001 | A | | 4/2000 | Miller et al. | |
| 6,616,201 | B1 | * | 9/2003 | Liang | 292/207 |
| 6,917,518 | B2 | * | 7/2005 | Chen | 361/724 |
| 7,013,687 | B2 | * | 3/2006 | Shedd et al. | 70/99 |
| 7,126,066 | B1 | | 10/2006 | Corcino et al. | |
| 7,543,409 | B2 | * | 6/2009 | Higashitani et al. | 49/278 |
| 7,578,531 | B1 | * | 8/2009 | Leontaridis | 292/11 |
| 2005/0104388 | A1 | | 5/2005 | Takes | |
| 2007/0158956 | A1 | | 7/2007 | Wang et al. | |
| 2007/0200370 | A1 | * | 8/2007 | Reithmeyer | 292/340 |
| 2009/0315341 | A1 | * | 12/2009 | Willcox | 292/163 |

FOREIGN PATENT DOCUMENTS

GB 2130293 A * 5/1984

* cited by examiner

*Primary Examiner* — Carlos Lugo
(74) *Attorney, Agent, or Firm* — Frederick Kaufman Inc.

(57) ABSTRACT

The apparatus comprises a gripping-operating unit including a gripping subassembly, a base subassembly for mounting the components of the unit and an operating subassembly. The gripping subassembly includes a gripper, from which, at one of its vertical extremity, a lever, integral with the gripper, extends horizontally. The base subassembly generally includes an elongated body and a positioning-attachment element connected to the latter. The operating subassembly comprises a spring guide block with opposed channels, a helical compression spring, located in one of the channels, and a pushing pin having a tooth like extension. Should the lever act on the pushing pin, the later, via the tooth like extension, operates against the helical compression spring, and simultaneously moves beyond the spring guide bloc.
When a lock is used, a subassembly strike-stopper and a lock actuator-stopper deactivator subassembly are included.

3 Claims, 18 Drawing Sheets

APPARATUS FOR EFFECTING AN INITIAL, PREDETERMINED TRANSLATION OF A CLOSED SLIDING DOOR

I. BACKGROUND OF THE INVENTION

1. Field of the Invention

The present invention relates, in general, to mechanisms for initiating a rectilinear and horizontal movement in the opening direction of sliding doors and, more specifically, to an apparatus for effecting an initial, predetermined translation of a closed sliding door.

2. Description of the Prior Art

Users, in general, and especially persons who have restricted manual strength or ability, find it excessively difficult to detach and push away, from their closed positions, the existing sliding doors. Furthermore, when opening mechanisms are associated with locks and the users are not aware that the latter are latched, they apply an enhanced detachment force that instead of the "breaking of the weather seal", could damage those mechanisms.

Attempts have been made to address the aforementioned problems and try, at least, to alleviate the existing situation. Thus, for example, U.S. Pat. No. 7,013,687 granted on Mar. 21, 2006 to Shedd et al. for a "SLIDING DOOR LOCK WITH SINGLE LOCK-RELEASE AND DOOR OPENING MOTION" describes a handle and lock assembly associated therewith. According to this patent, a sliding door is provided with a pivoted handle whose end is able to move angularly in a vertical plan between two stops. The sliding door incorporates as well an elongated bolt which extends vertically along the sliding door and is able to move between locking and unlocking positions. A locking mechanism is used and includes a motion converting and controlling mechanism which controls the vertical displacement of the elongated bolt. This mechanism comprises cams which cooperate with the elongated bolt and are associated with a rotary lock cylinder. When a force is applied against the handle, it causes the latter to rotate until it reaches a stop position. During the rotation of the handle, a hub is rotated causing a rotation of a driving gear which through other gears causes a downward movement of the elongated bolt into an unlocked, retracted position. Thus, the door is unlocked and ready to be open. A continued application of a horizontally directed force against the handle, when the latter is already in its unlocked position, causes this force to be effective in moving the door horizontally towards its open position.

The technical solution described in the above patent contains several shortcomings: 1) it is designed only for vertical locking mechanisms; 2) it cannot use conventional locking mechanisms, readily found on the market; 3) it is cumbersome; and 4) it is not provided with a mechanism for putting in motion a sliding door. Another example is United States Patent Application Publication No. 2007/0200370, published on Aug. 30, 2007. with Reithmeyer as inventor and with the title "GLIDING DOOR LATCH ASSEMBLY WITH ANTI-ACTIVATION MECHANISM". The latch assembly includes an anti-activation mechanism that comprises a depressible trigger projecting from a face plate of the latch toward a target zone on a strike plate, opposed to the face plate. The latch is operable when the trigger is depressed and is prevented from being operated when the trigger is extended. As long as the strike plate and the face plate are basically aligned, the trigger engages and is depressed by the target zone of the strike plate when the door is slid shut, thus allowing the operation of the latch to latch and lock the door. If the door becomes downwardly displaced with respect to the door's jamb so that the latch might not securely capture the keeper if deployed, the trigger does not engage the target zone, but instead extends into a fault aperture and is not depressed. The resulting inability of a user to operate the handle to deploy the latch, serves as an indication to the user of a misalignment of the door that should be corrected. The main disadvantages of this latch assembly reside in the following: 1) it requires a special latch instead of a conventional one; and 2) the alignment operation is not followed or associated by a movement of sliding door into an open position. Yet another example is Great Britain Patent Application No. 2,130,293, published on May 31, 1984 under the title "DOOR LOCKING MECHANISM" and having as inventors Tindall et al. The mechanism, being adaptable for use in doors which open in one or two directions and in sliding doors, comprises a sliding bolt movable between a locking position in which it projects from a door surface and a release position in which it is retracted. When a door is closed, the sliding bolt on a leading edge of the mechanism is depressed, e.g. by abutment against a doorjamb or against another door or other solid object, so that opposed sliders are held together and the spring-biased sliding bolt can move through slots in those sliders to automatically lock the door. When door is opened by a sliding bolt release feature, the release of the sliding bolt allows the sliders to be pushed apart by a leaf spring, so that the sliding bolt is firmly engaged by the slots and held in its release position. A mechanism having a catch release button on the leading edge of the door is used. The mechanism is not associated with a lock and acts only as a trigger that is hand activated, but not hand controlled.

II. SUMMARY OF THE INVENTION

Accordingly, a need exists for an apparatus for effecting an initial, predetermined translation of a closed sliding door, which eliminates or at lest alleviates the aforementioned shortcomings.

Thus, in developing the present invention, the inventor established the following objectives:

A first objective of the instant invention was to develop a versatile apparatus operable with or without a lock.

A second objective of the instant invention was, when the invented apparatus is operable with a lock, to be able to use a conventional type of lock for sliding doors, i.e. mass produced, tested and at a relatively low cost.

A third objective of the instant invention was to develop an apparatus with enhanced reliability and service life, which satisfies as well the demands of technical aesthetics.

Broadly stating, the apparatus for effecting an initial, predetermined translation of a closed sliding door, according to the present invention, comprises a hand gripping-operating unit, wherein are structurally and functionally combined the following:

a gripping subassembly;

a base subassembly for mounting components of the hand gripping-operating unit, the latter subassembly being vertically oriented and to which the gripping subassembly is pivotally connected; the base subassembly for mounting the components of the hand gripping-operating unit basically comprises an elongated body and a positioning-attachment element connected to the elongated body; and an operating subassembly, actuated by the gripping subassembly.

The gripping subassembly includes a gripper, from which, at one of its vertical extremity, a lever, integral with the gripper, horizontally extends.

The operating subassembly comprises a spring guide block with two intercommunicating, longitudinally opposed channels, a helical compression spring, located in one of the longitudinally opposed channels, and a pushing pin provided with a tooth like extension that, after traversing one of the longitudinally opposed channels, extends into the second one, behind the helical compression spring. The pushing pin includes as well lateral shoulders, so configured as to prevent penetration into one of the longitudinally opposed channels, which is adjacent to the lateral shoulders, to extend beyond an opening of one of the longitudinally opposed channels, so that they are in contact with a surface around the opening and are able to slide along it. Should the lever act on the pushing pin, the later, via the tooth like extension, operates against the helical compression spring, and simultaneously moves beyond the spring guide block, thereby pushing away the closed sliding door from a fixed door jamb or alike.

In one aspect of this invention, the elongated body, comprised in the base subassembly for mounting components of the hand gripping-operating unit, includes a horizontal slit for allowing a pivotal movement of the lever, while the positioning-attachment element, in the case when the apparatus for effecting an initial, predetermined translation of a closed sliding door is adapted to be associated with a lock, incorporates features for location and allowing an actuating of the lock.

In another aspect of the present invention, the apparatus for effecting an initial, predetermined translation of a closed sliding door further comprises a subassembly strike-stopper and a lock actuator-stopper deactivator subassembly.

The subassembly strike-stopper includes a door strike, adaptable to be vertically attached to a door jamb, and a stopper slidably interconnected with the door strike. The door strike incorporates an aperture coincidental with the pushing pin and the stopper incorporates a protrusion projecting centrally, from one framing vertical walls of a pair of framing vertical walls that flank the door strike, first inwardly and then outwardly-horizontally.

The lock actuator-stopper deactivator subassembly includes an actuator, adapted to perform locking-unlocking operations on the lock, via a deactivator that during the unlocking operation acts as well on the stopper, by disabling it. Thus, the stopper, when deactivates, allows free passage of the push pin.

The actuator has basically a crank shape form and incorporates an arm that extends at one end into a perpendicular projection, adapted to engage with and be turned by a thumb and a forefinger. At the opposite end, the arm extendes, on both sides, into a coaxial and commensurable in diameter cylindrical member, so dimensioned that its frontal part is engaged into the features for location and for allowing a functioning of a component used for locking and unlocking the lock. An actuator tail having a rectangular cross-section extends inwardly from the cylindrical member.

The deactivator incorporates a cylindrical element having a diameter commensurable with that of the cylindrical member. The cylindrical element is traversed by a longitudinal channel, shaped and sized for engaging the actuator tail. A plate having a concavity extending downwardly from said cylindrical element is provided. The concavity is so contoured as to engage the protrusion of the stopper during a rotation of the arm. During its rotation the arm oscillates in a lateral slot comprised in the features for location and for allowing an actuation of the lock. A deactivator tail, coplanar with the longitudinal channel and extending backwardly from the plate is adapted to be inserted into a longitudinal slot of the lock L.

By acting on the arm of the actuator, the deactivator tail rotates and causes locking or unlocking of the lock.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings, where like reference numerals refer to like parts throughout the several views of the drawings, in which:

FIG. 6A is a perspective view of

Figure 12:
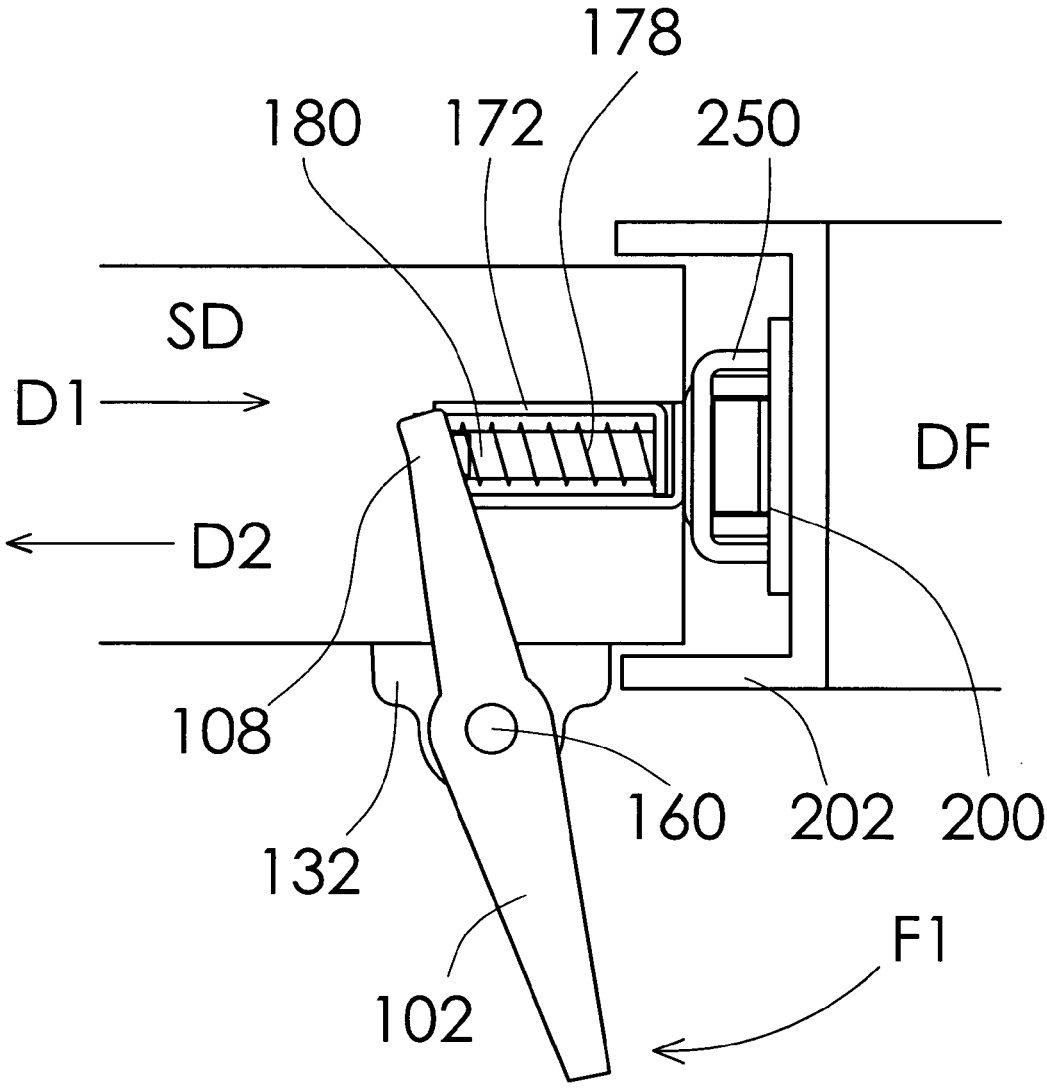
FIG. 12 is diagrammatic representation of the apparatus, which representation is used to explain the operation of the latter when a lock L is used and its hooks are in an unlocked position; stopper 250 is enabled to prevent passage of pushing pin 180.
Figure 12A:
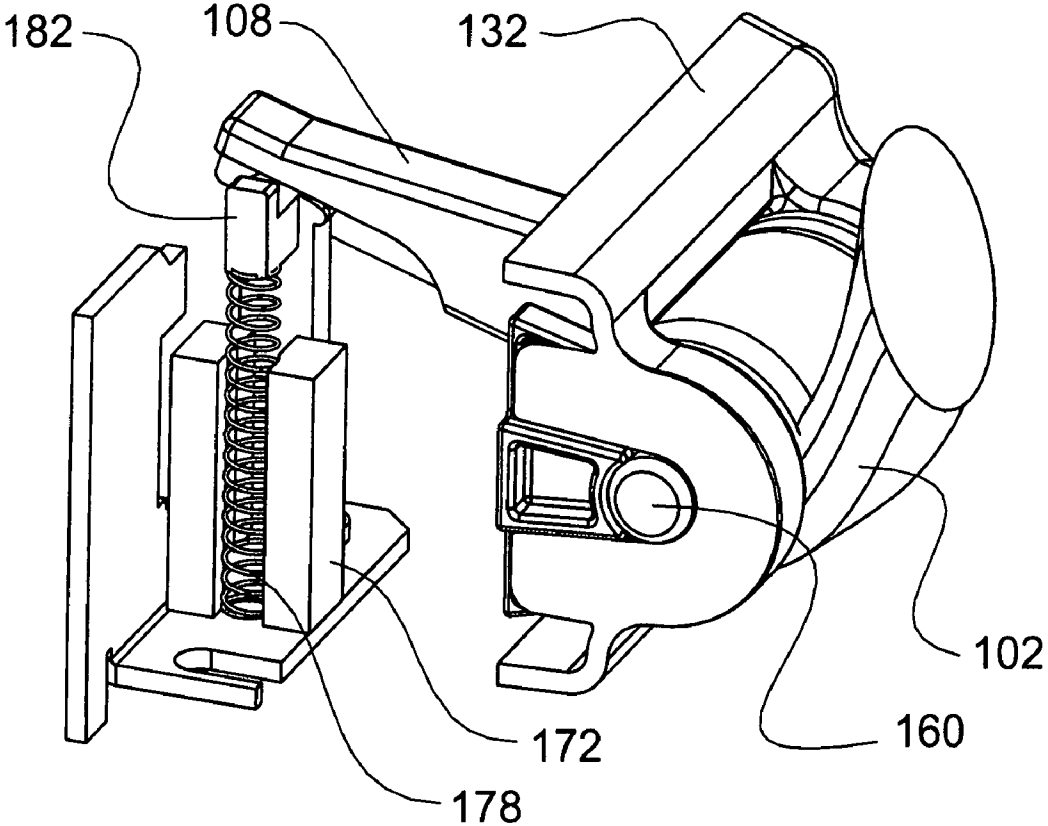
FIG. 12A is a vertically sectioned, perspective view of the apparatus showing some components of the gripping and operating subassemblies.
Figure 12B:
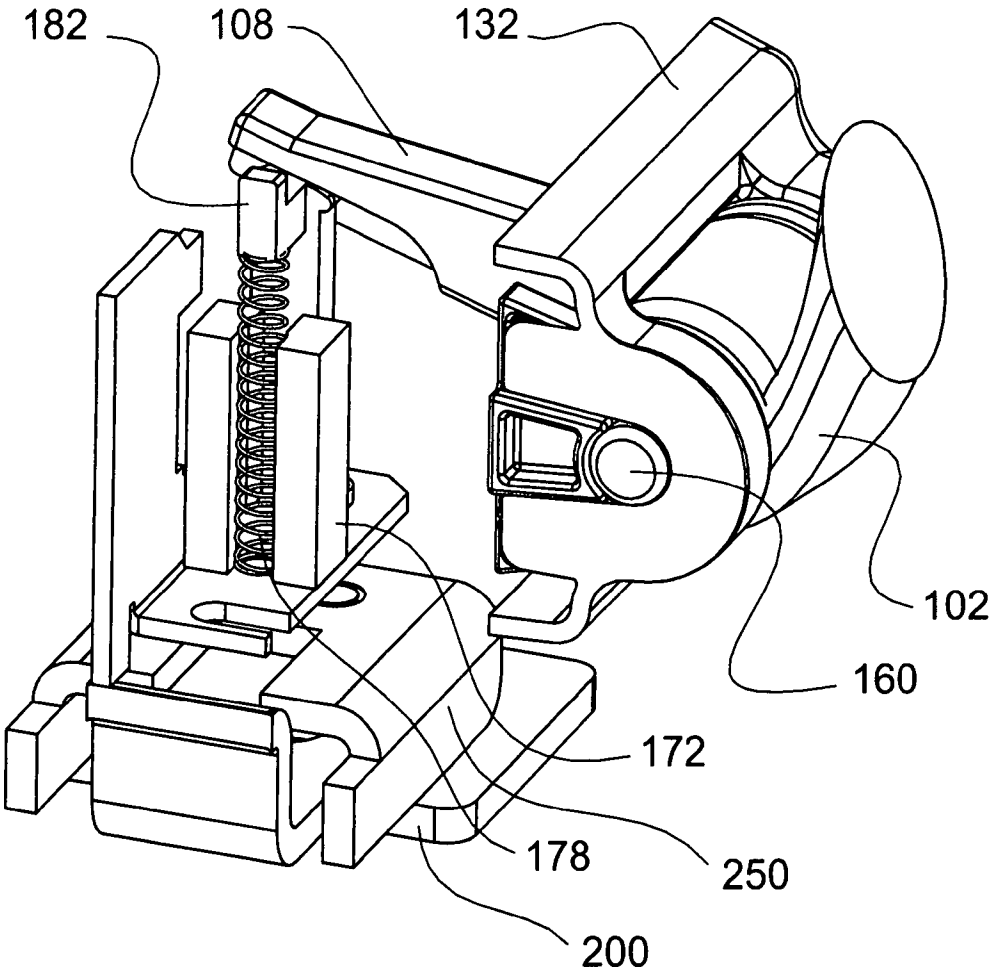
Figure 13:
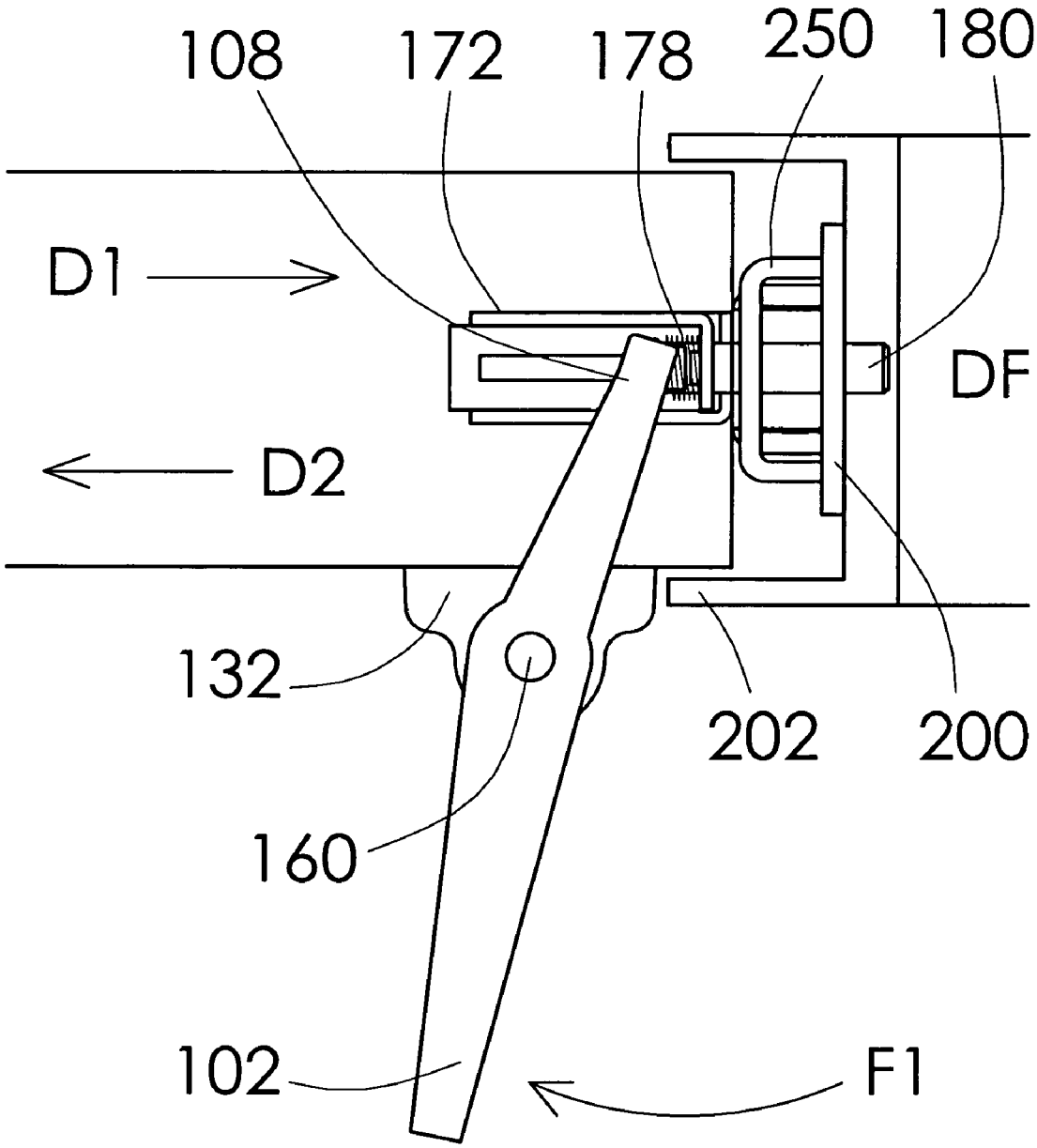
Figure 14A:
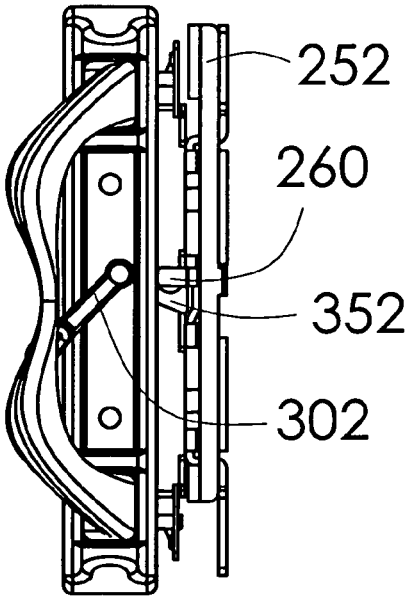
Figure 14B:
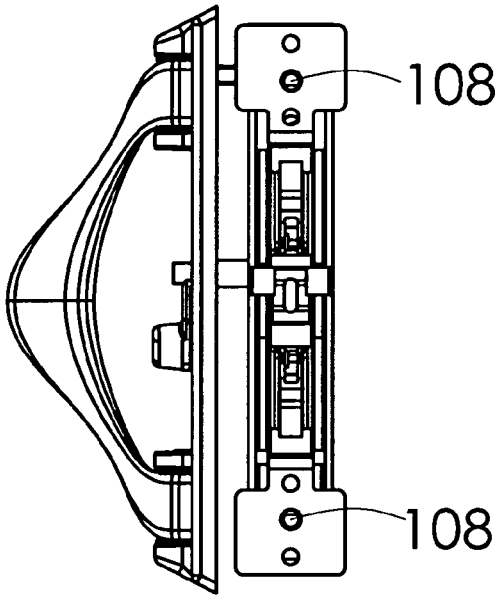
Figure 14C:
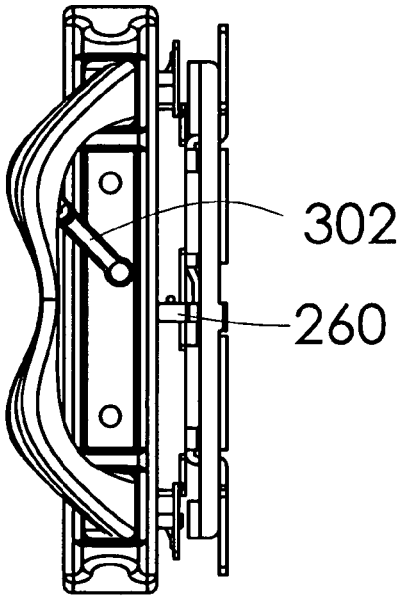
Figure 14D:
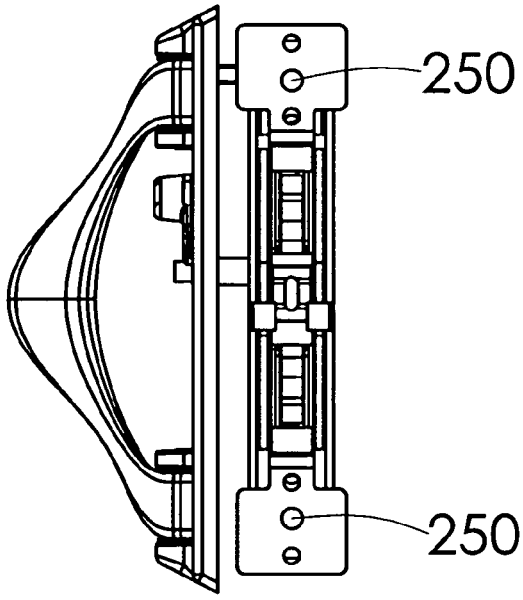

FIG. 12B incorporates FIG. 12A to which are added a door strike and a stopper;

FIG. 13 is diagrammatic representation of the apparatus, which representation is used to explain the operation of the latter when a lock L is used and its locks are in a locked position; stopper 250 is disabled to allow the passage of pushing pin 180;

FIGS. 14*a-d* are lateral and frontal elevations views of the apparatus depicting the initial (FIGS. 14*a-b*) and final (FIGS.

Figure 15:
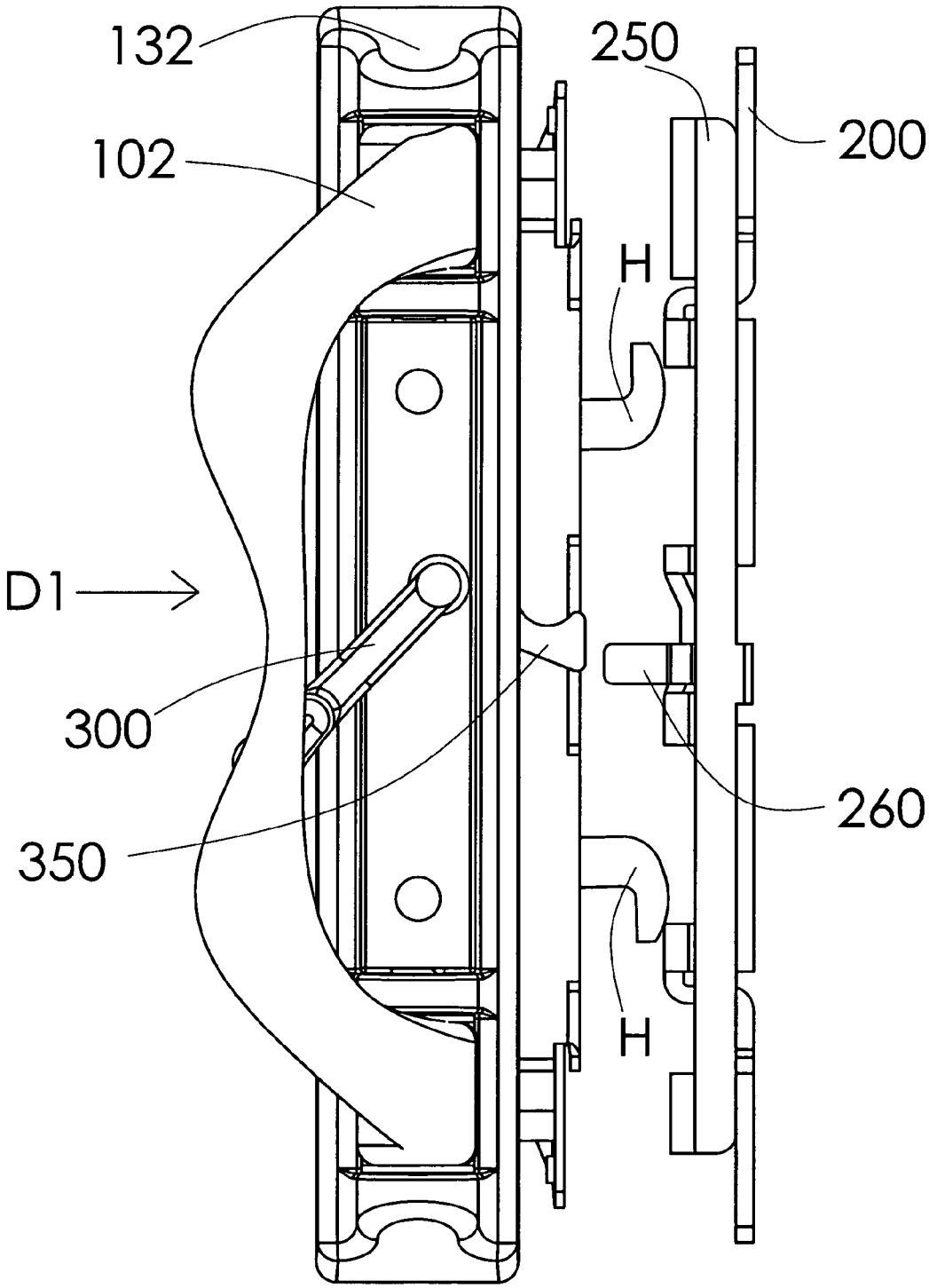

14*c-d*) operational stages of the latter, when lock L is unlatched and stopper 250 is enabled to prevent the passage of pushing pin 180; and FIG. 15 is a lateral elevation view of the apparatus when lock L has its hooks in a locked position but not engaged with door strike 200, the sliding door is open and stopper 250 is enabled to prevent the passage of pushing pin 180; protrusion 260 acts upon deactivator 350 to retract lock L into an unlocked state when door is closed, thereby an accidental damage to lock L is prevented.

IV. DESCRIPTION OF THE PREFERRED EMBODIMENTS

As mentioned above, the accompanying drawings illustrate preferred embodiments of an apparatus for effecting an initial, predetermined translation of a closed sliding.

But as a caveat, it is to be agreed, that terms, such as "top", "bottom", "vertical", "horizontal", "upward", "downward" and "outward" are conventionally employed in the present specification with reference to the normal position in which the apparatus for effecting an initial, predetermined translation of a closed sliding will be used.

Figure 1:
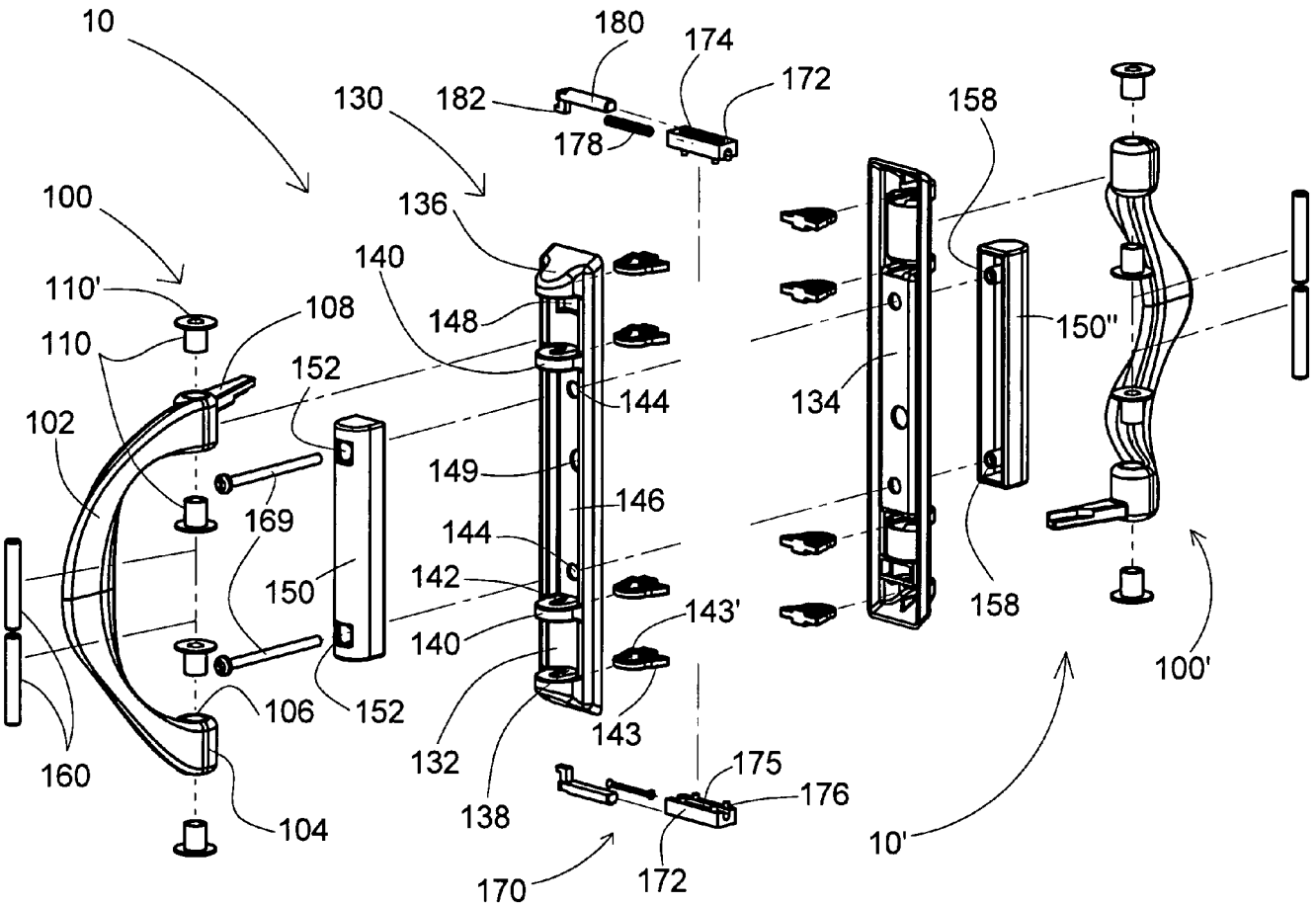
FIG. 1 is an exploded perspective view of the apparatus for effecting an initial, predetermined translation of a closed sliding door, when used without a lock.
Figure 2:
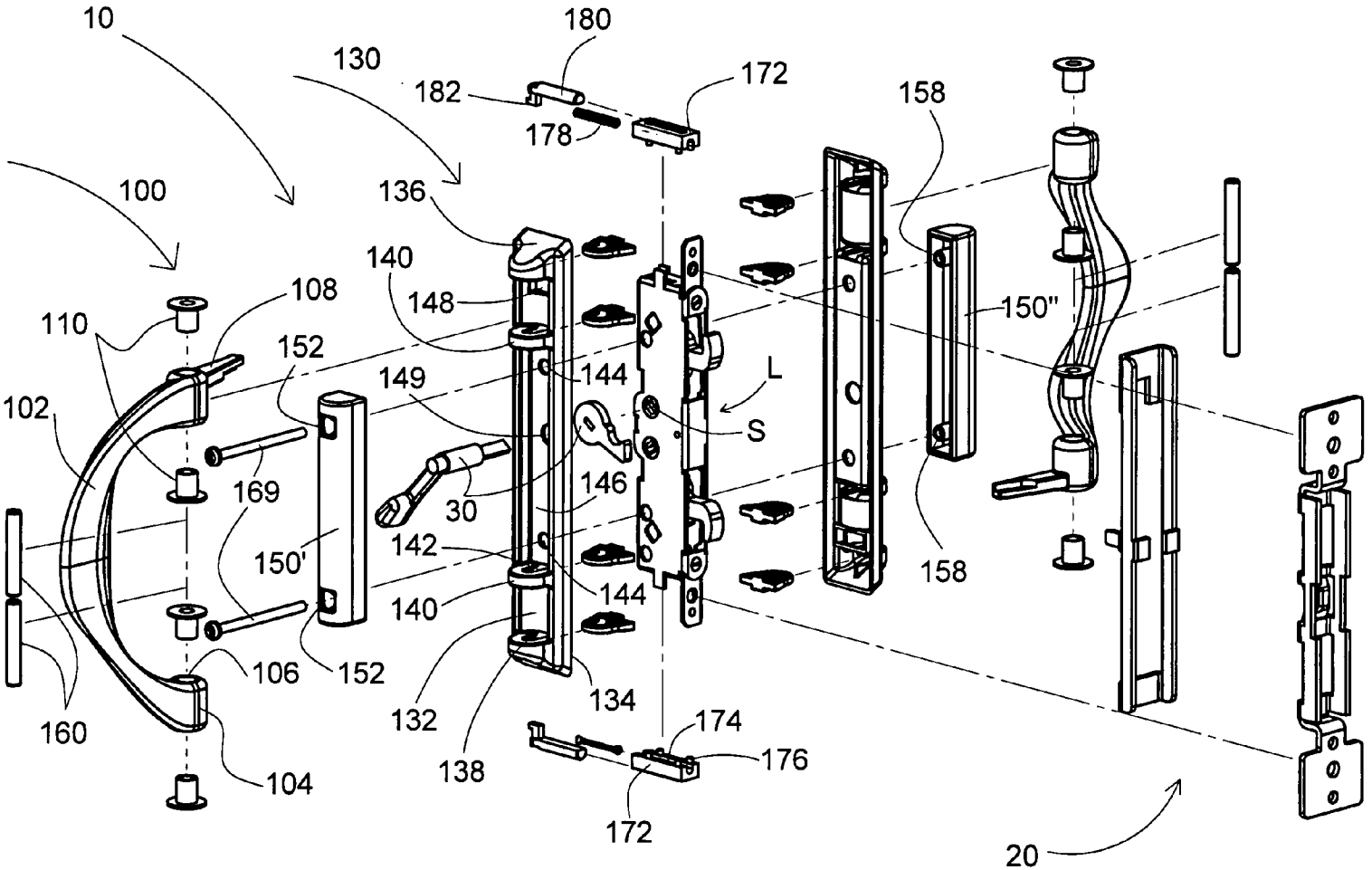
FIG. 2 shows the apparatus depicted in FIG. 1, when used in combination with a lock and a door strike.

Broadly describing, with reference to FIGS. 1 and 2, the apparatus for effecting an initial, predetermined translation of a closed sliding door comprises a hand gripping-operating unit 10 which includes a gripping subassembly 100;

a base subassembly 130, vertically disposed, and to which gripping subassembly 100 is pivotally connected; and an operating subassembly 170 actuated by gripping subassembly 100.

Gripping subassembly 100 includes a gripper 102, provided at each of its vertical extremities with a pivot pin boss 104 with a cross-drilled vertical hole 106. A lever 108, forming an integral part of gripper 102, projects horizontally from one of pivot pin bosses 104. Two pairs of collar bushings 110 are also included in gripping subassembly 100. Each of the pairs of collar bushings 110 is inserted from top and bottom into each cross-drilled vertical hole 106.

Base subassembly 130, used for mounting the components of hand gripping-operating unit 10, is vertically oriented and comprises an elongated body 132 having a flat back 134. Frontally, elongated body 132 has at each of its vertical ends a protuberance 136 provided with a first slot 138. An intermediary wall 140, parallel to and spaced from each adjacent protuberance 136, projects horizontally from and is unitary with elongated body 132. Each intermediary wall 140 is provided with a second slot 142, identical and coaxial with first slot 138. Frontally, elongated body 132 is provided between two intermediary walls 140, with two traversal openings 144, each of the latter being equally spaced from its proximate intermediary wall 140. Between two intermediary walls 140 a rectangular carving 146 is formed. Between one of the protuberances 136 and its adjacent intermediary wall 140 a horizontal slit 148 for allowing a pivotal movement of lever 108 is provided.

Alternatively, a supplementary opening 149, located between two traversal openings 144, is intended for use when hand gripping-operating unit 10 interacts with a lock L.

Figure 3A:
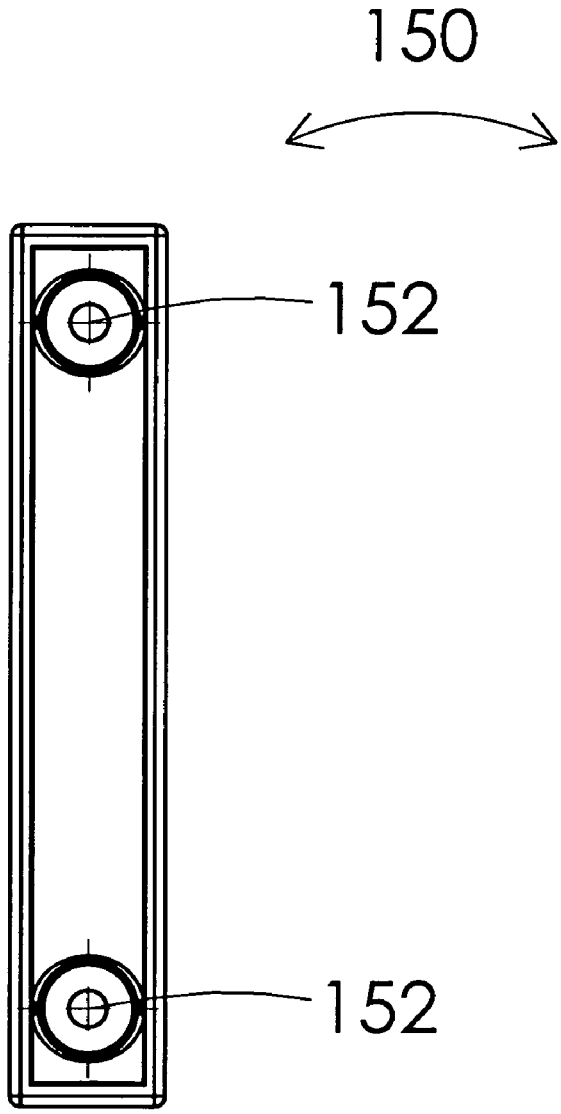
FIGS. 3A and 3B are, respectively, a back elevation view and an inside perspective view of positioning-attachment element used in a gripping subassembly, when no lock is used.
Figure 3B:
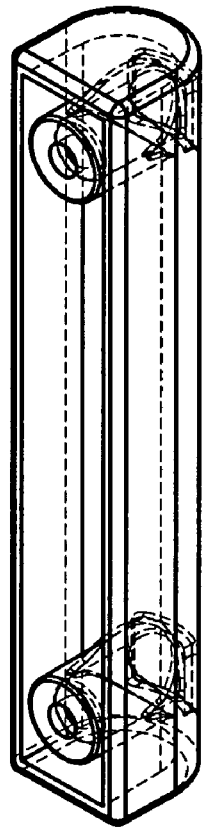

A positioning-attachment element 150 (see FIGS. 3A and 3B), dimensioned to fit into rectangular carving 146, is also part of base subassembly 130. Positioning-attachment element 150 has a long narrow open receptacle shape (trough) and incorporates a pair of apertures 152 that correspond coaxially to the two traversal openings 144 of elongated body 132.

Figure 4A:
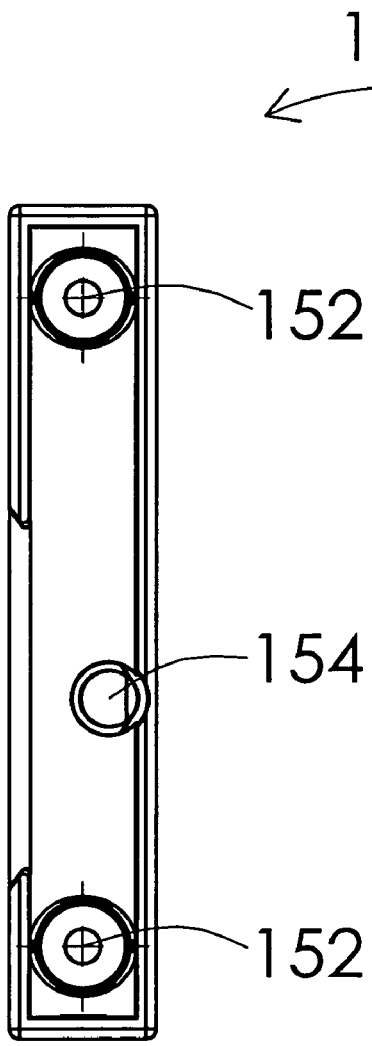
FIGS. 4A and 4B are, respectively, a back elevation view and a perspective view of a modified positioning-attachment element used in a gripping subassembly, when a lock is used.
Figure 4B:
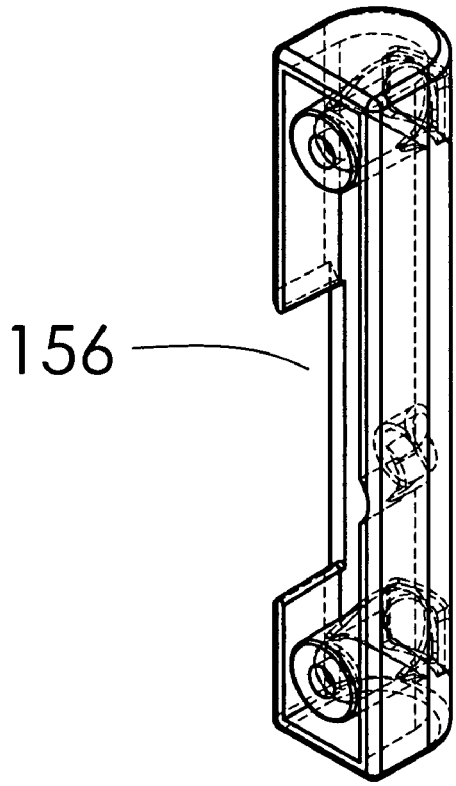

Alternatively, when hand gripping-operating unit 10 is adapted to interact with a lock L, a modified positioning-attachment element 150' (as shown in FIGS. 4A and 4B) is used. To the latter are added, in comparison with positioning-attachment element 150, a blind hole protrusion 154, coaxial with supplementary opening 149, and a lateral slot 156, the use of the former and the latter being intended to locate a further disclosed feature for actuation of lock L.

Figures 5A, 5B:
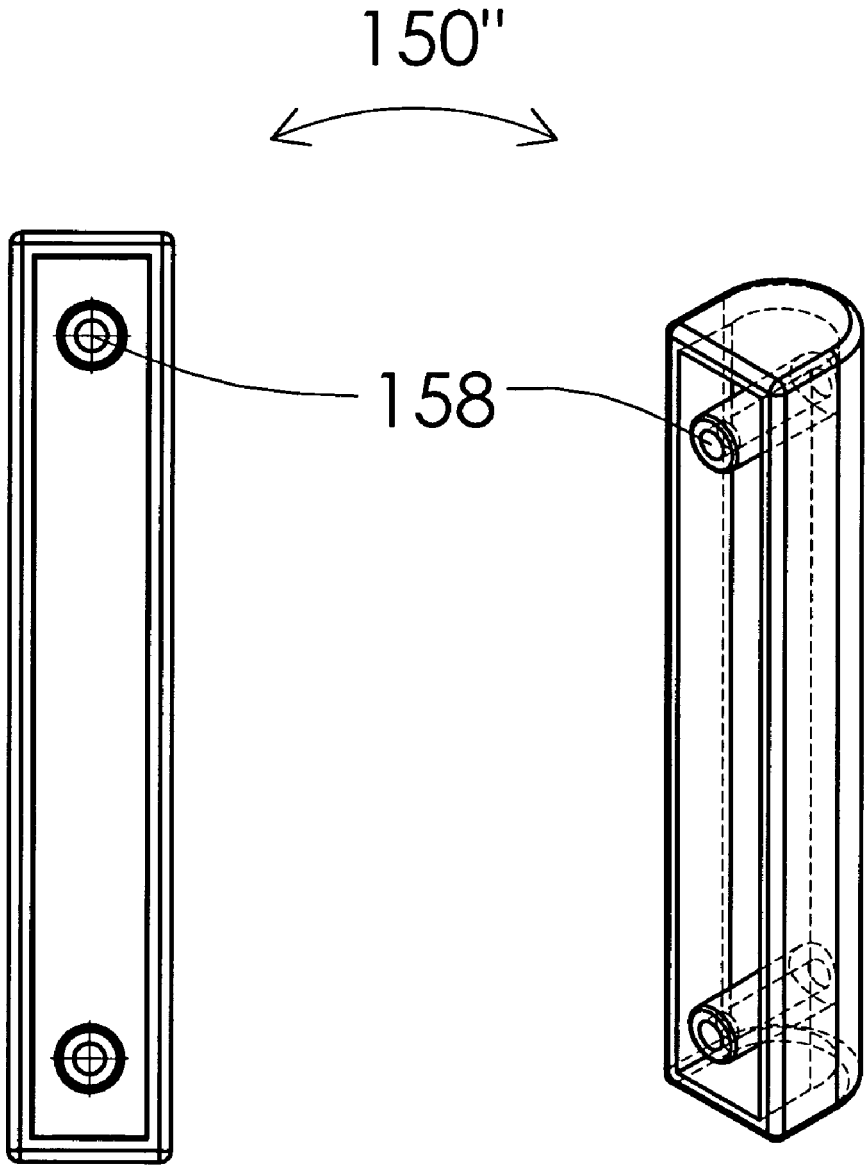
FIGS. 5A and 5B are, respectively, a back elevation view and a perspective view of a different positioning-attachment element used in a gripping subassembly, at the outside opposite side of a sliding door, either associated with the positioning-attachment element depicted in FIGS. 3A and 3B, or with the modified positioning-attachment element depicted in FIGS. 4A and 4B.

Usually, another hand gripping-operating unit 10' is adapted to be mounted on the other side of a door. Basically, in this arrangement, there are some differences:

elongated body 132 is turned at 180 degrees, so that horizontal slit 148 is at the bottom, lever 108 is located at the bottom of hand gripping-operating unit 100'; a supplementary opening 149 is not necessary; and a different positioning-attachment element 150" (as seen in FIGS. 5A and 5B) is required; the latter, when used either with or without a lock L, does not require a blind hole protrusion 154 and a lateral slot 156, since usually the lock L is activated only from one side of lock L; the different positioning-attachment 150" incorporates, instead of pair of apertures 152, two internally threaded protuberances 158 axially coincidental with the latter.

A pair of pivoting pins 160 is firstly used for assembling the components of hand gripping-operating unit 10. A retainer 143, provided with a bored hole 143', is inserted by sliding into each protuberance 136 and into each intermediary wall 140. Thus, the operation of assembling as follows: initially a pair of collar bushings 110, comprising a bore hole 110', are oppositely introduced into a cross-drilled vertical hole 106 of a pivot pin boss 104; then, with gripper 102 in place, pins 160 are inserted into bored hole 143' of a retainer 143 located in intermediary wall 140, and then into bored hole 110' of a bushing 110, and finally into another retainer 143 located in protuberance 136. A pair of screws 169 is then used. They are inserted into the pair of apertures 152 of positioning-attachment element 150, then, after passing through transversal openings 144 of elongated body 132 and elongated body 132, turned at 180 degrees, are tightened into two internally threaded protuberances 158.

Figure 6:
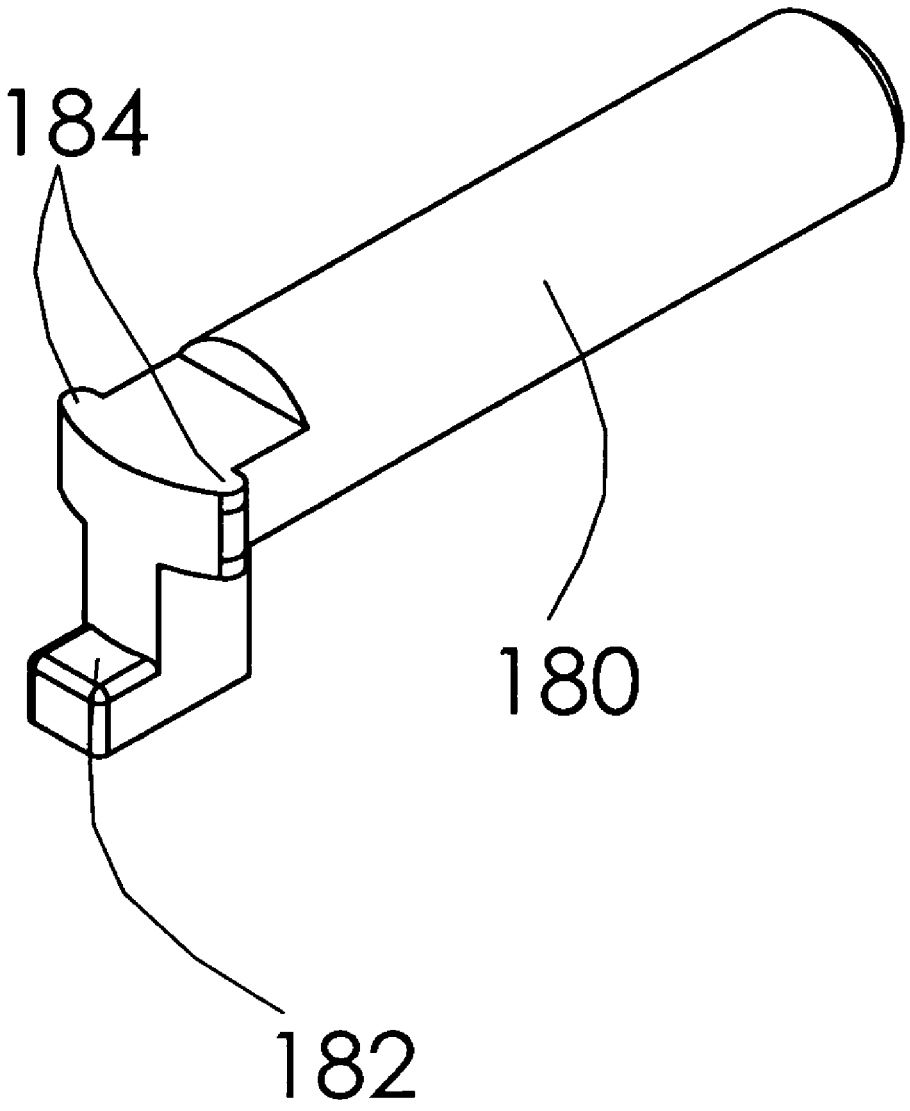
FIG. 6 is a perspective view of a pushing pin included in an operating subassembly actuated by the gripping subassembly.
Figure 6A:
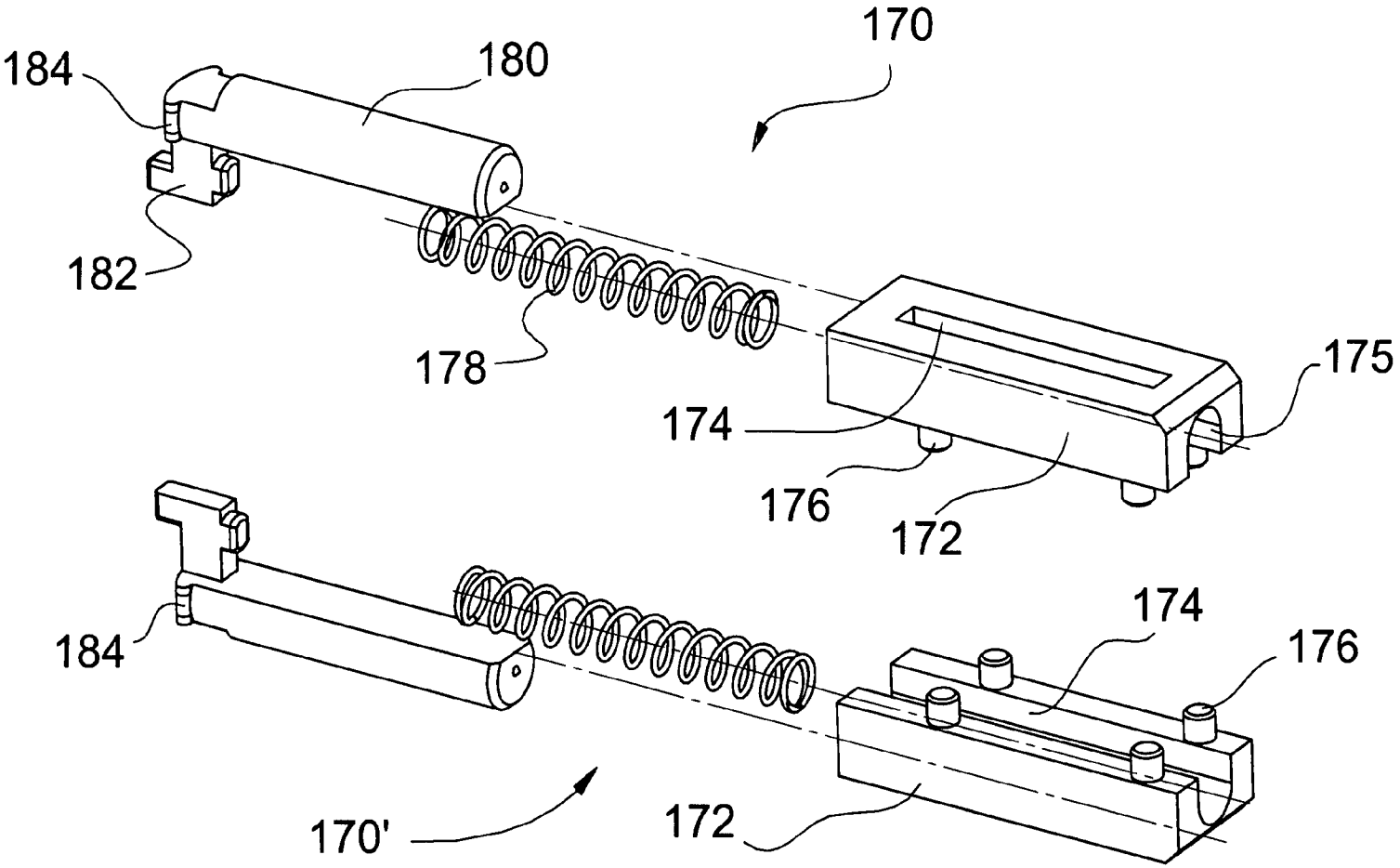

Operating subassembly 170 actuated by gripping subassembly 100 comprises:

a spring guide block 172, an upper one, having a top facing channel 174, closed at both ends, and bottom facing channel 175, open at both ends, top facing channel 174 communicating with bottom facing channel 175; spring guide block 172 is also provided with downwardly extending projections 176; the latter is adaptable to be secured to a door, when no lock L is used, or to a lock L, when the latter is used;

a helical compression spring 178 disposed into bottom facing channel 175;

a pushing pin 180 (see FIG. 6), provided with a tooth like extension 182, when it is assembled into spring guide block 172, traverses top facing channel 174 and extends into bottom facing channel 175, behind helical compression spring 178; pushing pin 180 includes as well lateral shoulders 184 which do not penetrate into top facing channel 174, but extend beyond top facing channel 174, respectively its opening, so that they contact with an upper surface around top facing channel 174 and are able to slide on the latter.

It is obvious that another operating subassembly 170' will be used at the other side of the door. In this case, spring guide block 172 will be rotated at 180 degrees, so that top and bottom facing channels 174 and 175 interchange their positions.

When hand gripping-operating unit 10 is associated with a lock L (see FIG. 2), a subassembly strike-stopper 20 and a lock actuator-stopper deactivator subassembly 30 are conjointly used with hand gripping-operating unit 10.

Figure 7:
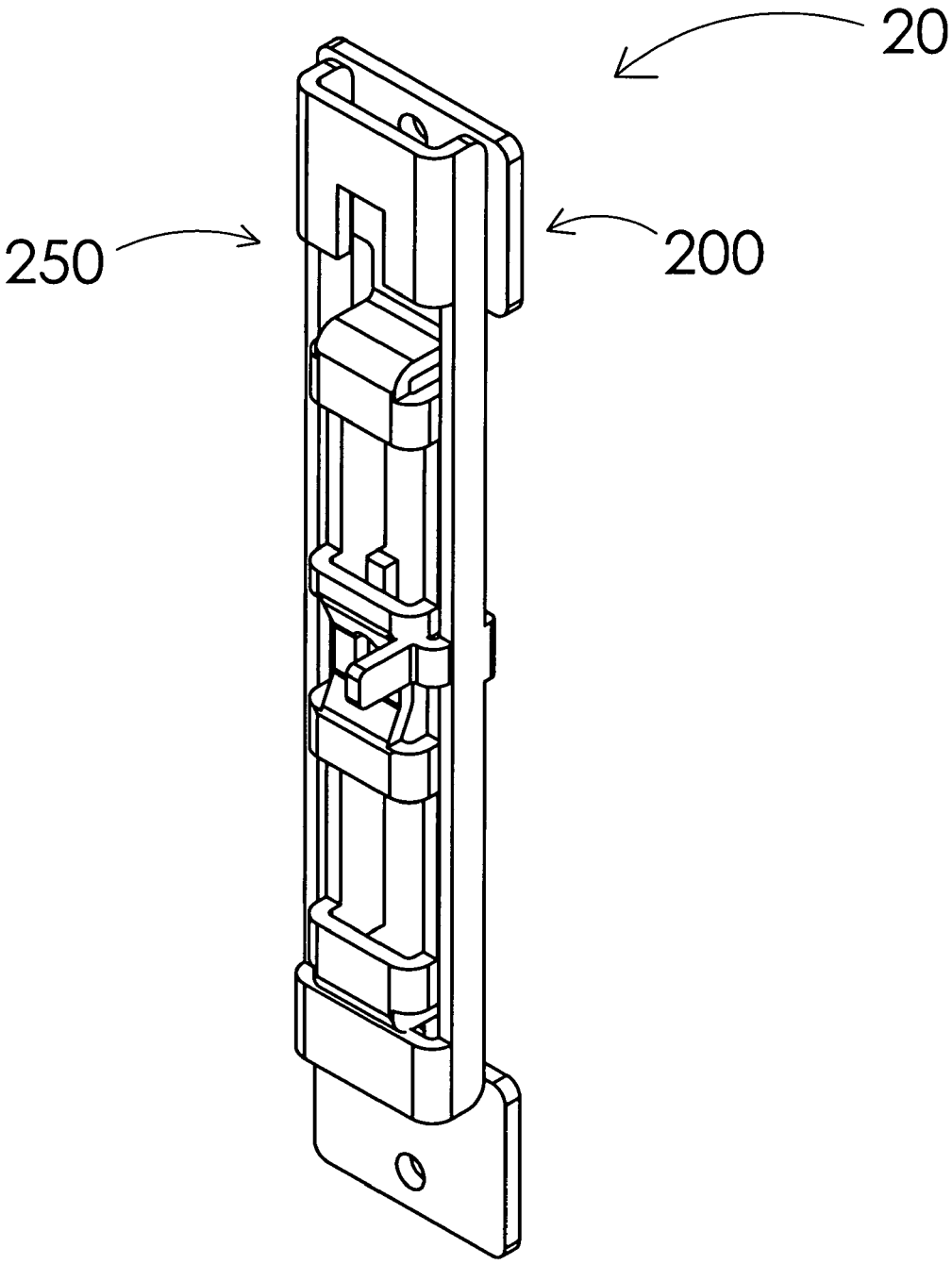
FIG. 7 is a perspective view of a strike-stopper subassembly.

Subassembly strike-stopper 20 (see FIGS. 7, 8 and 9) comprises a door strike 200, adaptable to be vertically attached to a door jamb 202 (see FIG. 13), and a stopper 250 slidably interconnected with door strike 200.

Door strike 200 (see FIG. 8) is basically defined by longitudinal and transversal axes of symmetry 204 and 206, by a back surface 208 contiguous to door jamb 202 (see FIG. 13), a front surface 210 opposite to back surface 208 and an intermediary surface 212, situated between back and front surfaces 208 and 210.

Door strike 200 incorporates, at each vertical extremity, a flange 214 followed perpendicularly by an outwardly extending horizontal wall 216, relatively narrower than flange 214. Each horizontal wall 216 is continued by a vertical front wall 218 coplanar with front surface 210. Vertical front wall 218 is relatively wider than horizontal wall 216, but relatively narrower than flange 214. A pair of lateral walls 220 flank vertical front wall 218 and reach back surface 208. Door strike 200 incorporates, as well, midway between flanges 214, a vertical element 222 having a central depressed zone 224 and provided centrally with a long narrow groove 226, adaptable for a supplementary central attachment. The central depressed zone 224 is provided with a slot 228 at each of its sides and is relatively narrower than the rest of vertical element 222. The pair of vertical front walls 218 and vertical element 222 are coplanar.

Door strike 200 includes two pairs of side walls 230 which are coplanar with and extend from the pair of lateral walls 220. Each side wall 230 has an outside edge 232, coplanar with intermediary surface 212 and an inside edge 234, coplanar with back surface 208. Between a pair of side walls 230 disposed in the same vertical plane, there is an intermediary wall 236 that frontally is commensurable in length with slot 228 and coplanar with intermediary surface 212; backwardly, intermediary wall 236 has a rectangular indentation 238, retracted with respect to adjacent inside edges 234 of the pair of side walls 230.

Each flange 214 is provided with an aperture a for passage of pushing pin 180 and another two mounting holes b for securing subassembly door strike-stop member 20. Aperture a and mounting holes b are all disposed on longitudinal axis of symmetry 204.

Stopper 250 (see FIG. 9) has also a shape of an elongated member and incorporates a framing vertical wall 252 disposed outside and adjacently to lateral vertical and side walls 220 and 230, respectively, both being incorporated into door strike 200. Between an internal surface of each framing vertical wall 252 and external surface of adjacent lateral and side walls 220 and 230, a horizontal clearance is provided.

At its upper end, stopper 250 is provided with a first vertical wall 254, horizontally spaced from framing vertical walls 252 from which it extends. First vertical element 254 includes a rectangular open cut 256 disposed towards the center of stopper 250.

At its lower end, stopper 250 is provided with a second vertical wall 258, relatively smaller than first vertical wall 254, horizontally spaced, as the latter, from framing vertical walls 252 from which it extends.

A protrusion 260 projects centrally from one of framing vertical walls 252, first inwardly and then outwardly-horizontally, thereby covering partially an adjacent slot 228.

A lap 262, generally situated at midway between the longitudinal extremities of stopper 250, extends, oppositely to protrusion 260, by bending at 90 degrees from each framing vertical walls 252, into rectangular indentation 238 of each intermediary wall 236.

Figure 10:
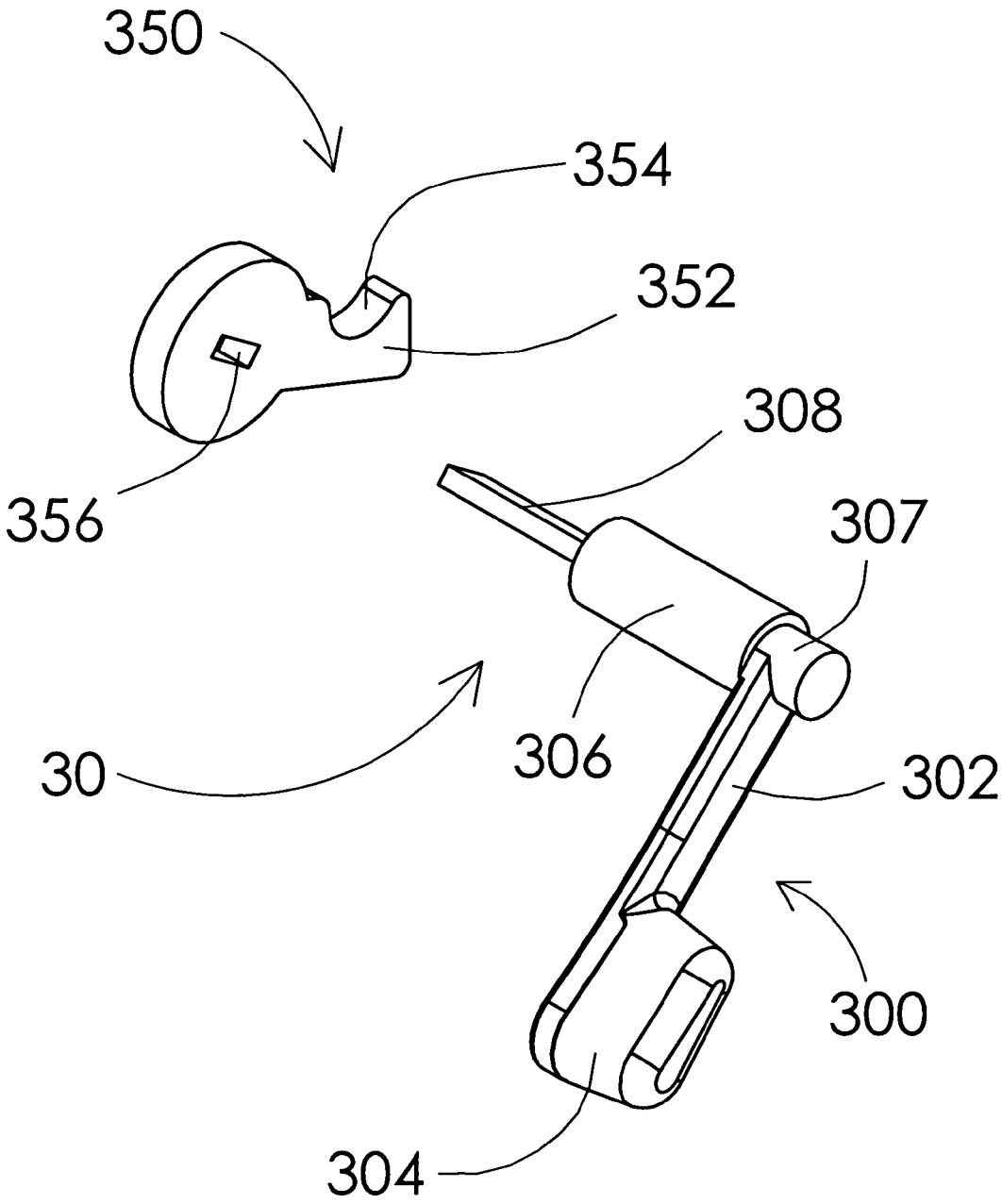
FIG. 10 is an exploded perspective view of lock actuator-stopper deactivator subassembly.

Lock actuator-stopper deactivator subassembly 30 (see FIG. 10) comprises an actuator 300, adapted to perform locking-unlocking operations on a lock L, via a deactivator 350 which during the unlocking operation acts as well on stopper 250, enabling it. Thus, stopper 250 allows pushing pins 180 to act on it and, hence, effect an initial predetermined translation of the sliding door.

Actuator 300 has basically a crank shape form and incorporates an arm 302 that extends at one end into a perpendicular projection 304 adapted to engage with and be turned by a thumb and a forefinger. At the opposite end of arm 302 and at the opposite side of perpendicular projection 304, arm 302 extends into a cylindrical spacer 306. A cylindrical element 307, coaxial with cylindrical spacer 306 and extending from arm 302 opposite to the latter, is provided. The latter is so dimensioned that its external end part is adaptable to be inserted, with a close-running fit, into blind hole protrusion 154 of positioning-attachment element 150'. There is a clearance fit between cylindrical spacer 306 and supplementary opening 149 of base subassembly 130. An actuator tail 308 having a rectangular cross-section extends outwardly from cylindrical spacer 306. If one considers arm 302 having, in a certain position, its longitudinal axis of symmetry (not shown) vertically disposed, actuator tail 308 will have its longitudinal cross-section plane (not shown) disposed in a plan slightly deviated from a horizontal plane.

Deactivator 350 incorporates a plate 352 provided with a concavity 354. Plate 352 is traversed by a longitudinal channel 356. The latter is shaped and sized for engaging actuator tail 308. Concavity 358 is so configured as to engage protrusion 260 of stopper 250 during the rotation of arm 302. During its rotation, arm 302 oscillates in lateral slot 156 of positioning-attachment element 150'. Actuator tail 308 is adapted to be inserted into a longitudinal slot S of lock L; by acting on arm 302, namely on perpendicular projection 304 of actuator 300, actuator tail 308 rotates and causes locking or unlocking of lock L.

Operation

Figure 11:
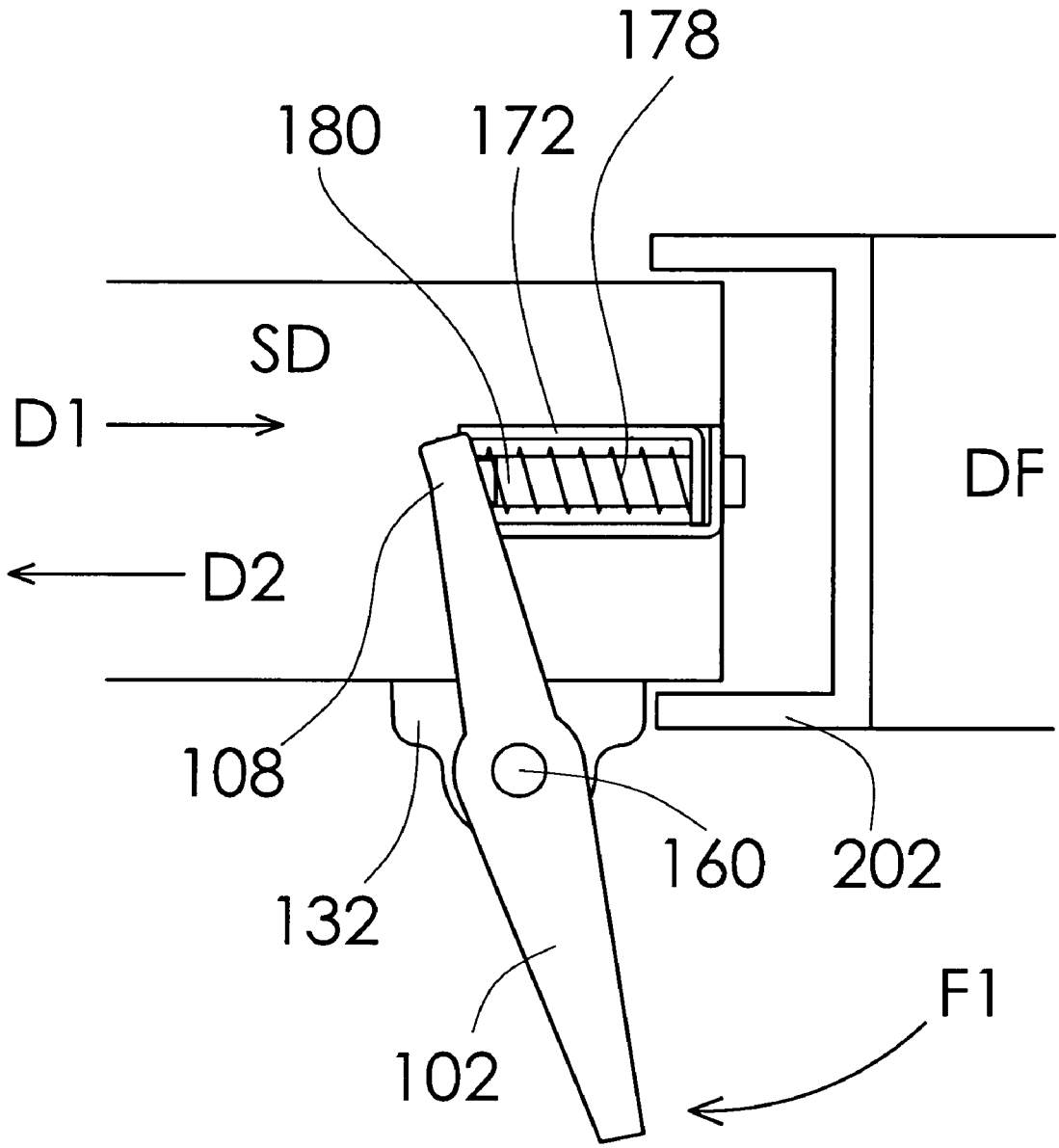
FIG. 11 is diagrammatic representation of the apparatus, which representation is used to explain the operation of the latter, when no lock is used.
Figure 11A:
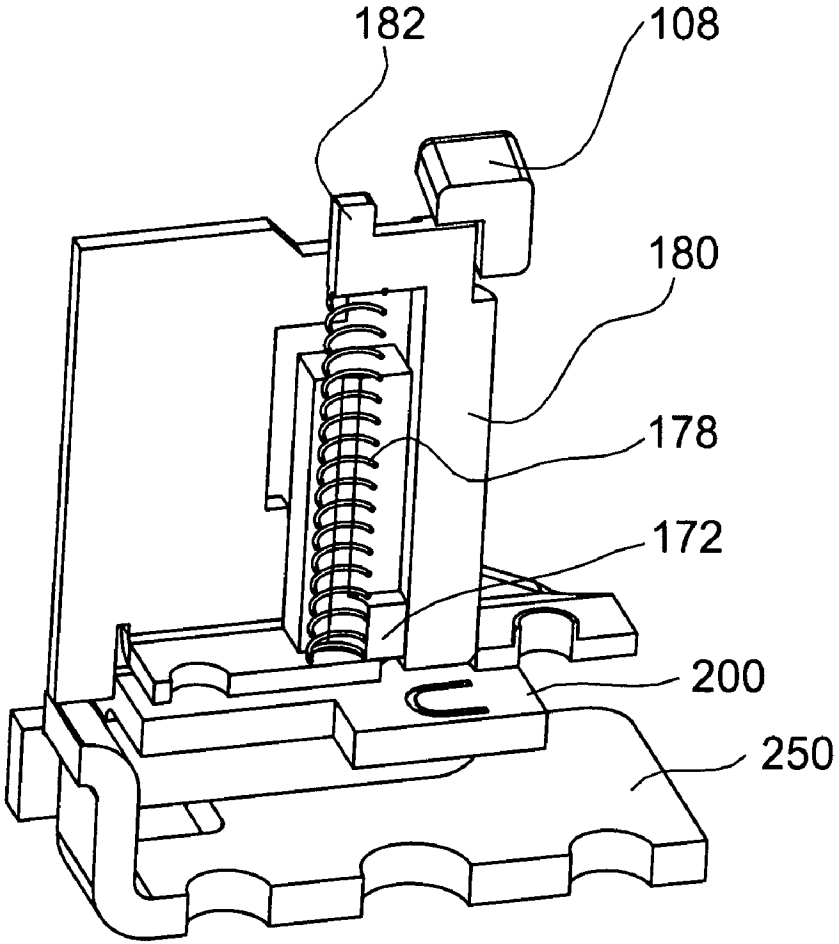
FIG. 11A is a vertically sectioned, perspective view of the apparatus, wherein a juxtaposition of the pushing pin with a helical compression spring is depicted (the pushing pin has its tooth extension located at one end of the helical compression spring)

1. The Apparatus According to the Present Invention Operating Without a Lock (See FIG. 11).

Elongated body 132 of base subassembly 130 is used for mounting hand gripping-operating unit 10 to a sliding door SD and for allowing gripper 102 to rotate about the pair of pivoting pins 160. Spring guide block 172 is used to limit the movements of pushing pin 180 and helical compression spring 178 in $D_1$ and $D_2$ directions.

Should a force $F_1$ be applied to gripper 102, in a clockwise direction, pushing pin 180 will be displaced by lever 108, which is integral with gripper 102, in $D_1$ direction, until it contacts door frame DF. Should sufficient force $F_1$ is applied to gripper 102, pushing pin 180 will act on door frame DF causing sliding door S to move in $D_2$ direction. When force $F_1$ ceases, compression spring 178 displaces pushing pin 180 also in $D_2$ direction, thereby causing the return of gripper 102 to its initial position.

2. The Apparatus is Associated with a Lock L Having its Hooks in an Unlocked Position; Stopper 250 is Enabled to Prevent Passage of a Pushing Pin 180 (see FIG. 12).

When lock's hooks are in an unlocked position and should a force $F_1$ be applied to gripper 102, in a clockwise direction, pushing pin 180 will be displaced by lever 108, which is integral with gripper 102, in $D_1$ direction, until it contacts stopper 250. Should sufficient force $F_1$ be applied to gripper 102, pushing pin 180 will act on stopper 250 causing sliding door SD to move in $D_2$ direction. When force $F_1$ ceases, compression spring 178 displaces pushing pin 180 also in $D_2$ direction, thereby causing the return of gripper 102 to its initial position.

3. The Apparatus is Associated with a Lock L Having its Hooks in a Locked Position; Stopper 250 is Disabled to Allow the Passage of Pushing Pin 180 (see FIG. 13).

In this situation, a force $F_1$ can be applied to gripper 102, in a clockwise direction, causing pushing pin 180 to be displaced by lever 108, which is integral with gripper 102, in $D_1$ direction. Thus, lever 108 and pushing pin 180 are protected against damage, since the latter can pass unimpeded through rectangular open cut 256 of stopper 250, door strike 200 and door jamb 202, and abut door frame DF.

4. The Apparatus is Associated with a Lock L Having its Hooks in a Locked Position; Unlocking Lock L and Enabling Stopper 250 to Prevent Passage of Pushing Pin 180 are Depicted (See FIGS. 14*a-d* and FIG. 13).

For unlocking, when lock's L hooks are in a locked position, actuator 300 acts on lock L via deactivator 350, the latter during the unlocking operation acts as well on stopper 250 by enabling it. For this, a force $F_1$ is applied to gripper, in a clockwise direction, causing pushing pin 180 to be displaced by lever 108, which is integral 102, in $D_1$ direction until it contacts stopper 250. Should sufficient force $F_1$ be applied to gripper 102, pushing pin 180 will act on stopper 250 causing sliding door SD to move in $D_2$ direction. When force $F_1$ ceases, compression spring 178 displaces pushing pin 180 also in $D_2$ direction, thereby causing the return of gripper 102 to its initial position.

5. Lock Having its Hooks in a Locked Position, Door Open and Stopper 250 Enabled to Prevent Passage of Pushing Pins (See FIG. 15).

Figures 8, 9:
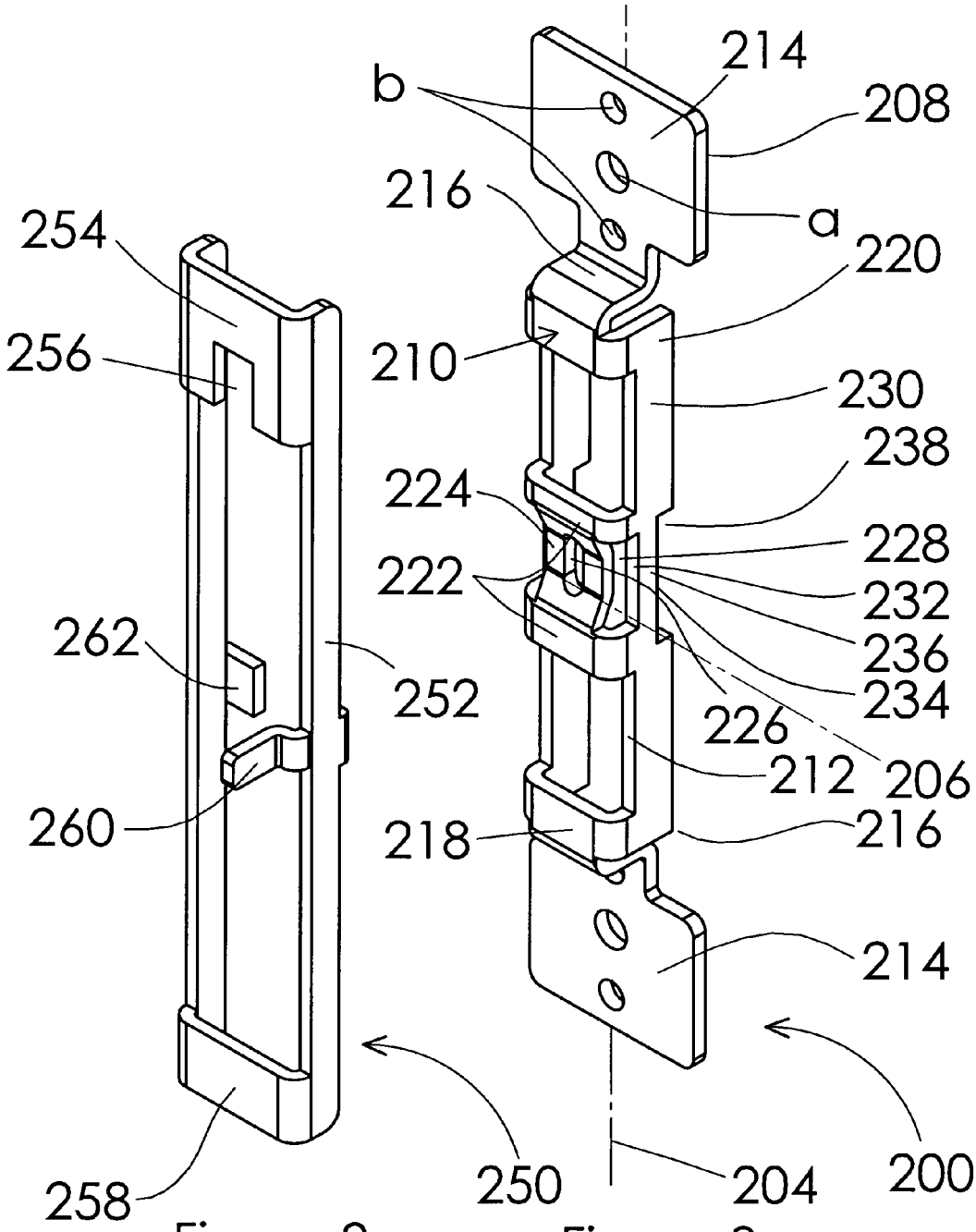
FIG. 8 is a perspective view of a door strike comprised in the strike-stopper subassembly illustrated in FIG. 7.
FIG. 9 is a perspective view of a stopper comprised in the strike-stopper subassembly illustrated in FIG. 7.

To prevent damage while sliding door S is moved towards closing, with the hooks of the lock in an extended/locked position/, protrusion 260 shown in FIG. 9, encounters, engages, and rotates plate 356 (see FIG. 10), respectively recess 358 of deactivator 350, causing the latter to rotate and, thereby, retract the hooks H into the lock housing.

What I claim is:

1. An apparatus for effecting an initial, predetermined translation of a closed sliding door, said apparatus being adapted for initially pushing away said closed sliding door from a fixed door jamb toward an open position, said apparatus comprising a hand gripping-operating unit, wherein are structurally and functionally combined the following: means for gripping; base means for mounting components of said hand gripping-operating unit, the latter means being vertically oriented and to which said means for gripping is pivotally connected; said base means for mounting the components of said hand gripping-operating unit basically comprising an elongated body and a positioning-attachment element connected to said elongated body; means for operating, actuated by said means for gripping; said means for gripping including a gripper, from which, at one of its vertical extremity, a lever, integral with said gripper, is horizontally extending; said means for operating comprising an upper and a lower spring guide block, said upper spring guide block incorporating two intercommunicating, longitudinally opposed channels: an upper, top facing channel, closed at both ends, and a lower, bottom facing channel, open at both ends; a helical compression spring disposed into said lower, bottom facing channel; a pushing pin provided with a tooth extension, laterally projecting, said tooth extension, after traversing said upper, top facing channel, penetrates into said lower, bottom facing channel, behind one end of said helical compression spring; said pushing pin incorporating as well lateral shoulders that contact an upper external surface situated around and along said upper, top facing channel and are able to slide together with said pushing pin on the latter;

whereby said pushing pin is used for an initial detaching of said closed sliding door from said fixed door jamb, while said tooth extension, which projects laterally from said pushing pin, operates against said helical compression spring to retract said pushing pin after the initial detachment ceases; and when said apparatus for effecting an initial, predetermined translation of a closed sliding door will be used for the other side of said door, said spring guide block will be rotated at 180 degrees, so said upper, top facing channel and said lower, bottom facing channel interchange their positions.

2. The apparatus for effecting an initial, predetermined translation of a closed sliding door, as defined in claim 1, wherein said elongated body, comprised in said base means for mounting components of said hand gripping-operating unit, includes a horizontal slit for allowing a pivotal movement of said lever, and wherein said positioning-attachment element, when said apparatus for effecting an initial, predetermined translation of a closed sliding door is adapted to be associated with a lock, incorporates means for location and allowing an actuating of said lock.

3. The apparatus, as defined in claim 2, further comprising means for striking-stopping and means for lock actuating-stopper deactivating, said means for striking-stopping including a door strike, adaptable to be vertically attached to a door jamb, and a stopper slidably interconnected with said door strike; said door strike incorporating an aperture coincidental with said pushing pin and said stopper incorporating a protrusion projecting centrally, from one framing vertical walls of a pair of framing vertical walls that flank said door strike, first inwardly and then outwardly-horizontally; and said means for lock actuating-stopper deactivating including an actuator, adapted to perform locking-unlocking operations on said lock, via a deactivator that during the unlocking operation acts as well on said, stopper, by disabling it, thus, stopper cannot prevent said pushing pin to act on a door frame and detach said sliding door; said actuator having basically a crank shape form and incorporating an arm that extends at one end into a perpendicular projection, adapted to engage with and be turned by a thumb and a forefinger; at the opposite end, said arm extending, on both sides, into a coaxial and commensurable in diameter cylindrical member, so dimensioned that its frontal part is engaged into said means for location and for allowing a functioning of a component used for locking and unlocking said lock; an actuator tail having a rectangular cross-section extends inwardly from said cylindrical member; and said deactivator incorporating a cylindrical element having a diameter commensurable with that of said cylindrical member is traversed by a longitudinal channel, shaped and sized for engaging said actuator tail; a plate, having a concavity extending downwardly from said cylindrical element, being provided; said concavity being so contoured as to engage said protrusion of said stopper during a rotation of said arm; during its rotation said arm oscillates in a lateral slot comprised in said means for location and allowing an actuation of said lock; a deactivator tail, coplanar with said longitudinal channel and extending backwardly from said plate being adapted to be inserted into a longitudinal slot of said lock; whereby by acting on said arm of said actuator, said deactivator tail rotates and causes locking or unlocking of said lock.

* * * * *